United States Patent [19]

Haver et al.

[11] Patent Number: 4,691,744

[45] Date of Patent: Sep. 8, 1987

[54] FILTER WIRE CLOTH

[75] Inventors: Eitel F. Haver; Heinz Lütke-Föller; Reinhard Wössmann, all of Oelde, Fed. Rep. of Germany

[73] Assignee: Haver & Boecker, Oelde, Fed. Rep. of Germany

[21] Appl. No.: 848,906

[22] Filed: Apr. 4, 1986

Related U.S. Application Data

[63] Continuation of Ser. No. 702,873, Feb. 19, 1985, abandoned.

[30] Foreign Application Priority Data

Aug. 7, 1984 [DE] Fed. Rep. of Germany ..... 3429021

[51] Int. Cl.[4] ..... D03D 15/02

[52] U.S. Cl. ..... 139/425 R; 139/425 H; 210/486; 210/499; 210/791; 245/2

[58] Field of Search ..... 245/2; 139/425 R, 425 A; 210/486, 489, 791

[56] References Cited

U.S. PATENT DOCUMENTS

| | | | |
|---|---|---|---|
| 1,304,918 | 5/1919 | Sweetland | 245/2 X |
| 2,082,513 | 6/1937 | Roberts | 245/2 X |
| 2,274,684 | 3/1942 | Goodloe | 245/2 X |
| 3,502,116 | 3/1970 | Crawford | 245/2 X |

*Primary Examiner*—Howard N. Goldberg
*Assistant Examiner*—Joseph M. Gorski
*Attorney, Agent, or Firm*—Fay, Sharpe, Beall, Fagan, Minnich & McKee

[57] ABSTRACT

A wire cloth for a filter has a twill lace weave which is formed in patterns alternating in the direction of the twill line. The alternation is provided substantially in the region of weft wires. At least one intermediate weft wire is introduced in the region of discontinuity of the twill line whereby the position of the weft wires in each pattern of the twill weave is fixed and a mesh size in the weave can be accurately determined.

8 Claims, 3 Drawing Figures

FILTER WIRE CLOTH

This application is a continuation of application Ser. No. 702,873, filed, Feb. 19, 1985, now abandoned.

BACKGROUND OF THE INVENTION

The present invention relates to a wire cloth for a filter, having a twill strip weave.

Wire cloths of the foregoing type have been known These wire cloths have been known as twilled metal twist weaves. These cloths can be so-called light-tight twilled metal laces or strips or open twilled metal laces or strips In the case of light-tight twill strips the weft wires are introduced into the twill weave as close to each other as possible Thereby one weft wire always lies above the warp wire and one weft wire lies below the warp wire so that the weft wires are positioned tightly to each other. The advantage of these closely positioned twill strips resides in an optimal accuracy during the filtration proces However, the disadvantage of such filter cloth is its relatively low discharge output so that the utilization of such filter cloth is suitable only for low-viscous agents Furthermore, such filter cloth causes relatively high pressure losses.

With so-called open twill strips also known as coarse-mesh twill, the weft wires are loose and are not positioned closely adjacent to each other. Therefore the diameter of the weft wire and the number of the wefts per a fabric length unit in dm, cm, etc. must be determined preliminarily for each application. Thus the intervals between the weft wires define a discharge output and pressure losses of such filter cloth. The interstices between weft wires, which are defined as a mesh size of the filter cloth must be determined in many filtration methods as accurate as possible. For example, with the filter including spinning nozzles and used for producing fibers in a textile industry such a determination of the mesh size with the open twill strips is not obtainable. The difficulty occurs with such open strips in that the weft wires, which form a twill seam, can move towards the warp fibers. The intervals between the weft fibers are defined in such cloth by specific features of the cloth beam in a loom. An accurate defermination of the mesh size is not possible during the manufacture of such filter cloth either.

SUMMARY OF THE INVENTION

It is an object of the present invention to provide an improved filter cloth.

This and other objects of the invention are attained by a wire cloth for a filter, having a twill-strip weave and comprising warp wires and weft wires forming a plurality of alternating patterns in the direction of a twill line; and at least one intermediate weft wire inserted in the weave in the region of disruption of a twill line course, said intermediate weft wire changing a uniform tying of the weft wires.

The objects of this invention are also attained by a wire cloth for a filter, having a twill-strip-weave and comprising warp wires and weft wires forming a plurality of alternating patterns in the direction of a twill line; and at least one intermediate warp wire inserted in the weave in the region of disruption of a twill course, said intermediate warp wire changing a uniform tying of the warp wires.

Due to the present invention after the insertion of a predetermined number of wefts by changing resistance to friction of the weft fibers relative to the warp fibers the fixation of the position of the weft fibers in one pattern is practically achieved whereby a uniform, accurately defined mesh size in each pattern region and therefore in the filter cloth is obtained.

The filter cloth according to the invention provides reproducible products when in the cloth itself various mesh-regions are available. Thus each desired filter mesh can be obtained, which can change a strewing of filter mesh sizes and which can more or less determine the porosity of the filter.

The disruption of the twill line can be preferably obtained by the insertion of from one to three intermediate wefts so that the direction of the twill line be changed.

In the warp twill one or more intermediate warp wires can be inserted whereby the warp twill has the disadvantage that the intervals between the warps would be fixed and therefore various widths in defining of mesh sizes would not be quickly available. In order to determine certain mesh sizes a weft twill is always preferable as well as the arrangement including at least one intermediate weft. The width variations in the direction of wefts for manufacturing open twill strips are extremely good.

In the case of a double twill formation, in which floating fibers are provided in the weft direction and the warp direction, an expert would place a pattern alternation in the direction of the twill line and thus introduce a disruption in that line.

It is advantageous that a uniformly bound double twill, preferably a 4-tie double twill, be produced because the fixation of the wefts relative to the warps would be ensured in such twill.

It should be considered that during the alternation of each cycle weft wires lie in a shed and can be damaged during fixing. The fear that wefts would break can occur if a change taken place in the twill is eliminated due to the insertion of intermediate wefts into the twill. Individual weft fibers in the twill of this invention are also subjected to higher loads but they do not break.

The intermediate weft wire may lie in the region of disruption of the twill whereby said intermediate weft wire forms tips in both directions of the twill line.

The intermediate weft wire may be adjusted in both directions of the twill line.

Two intermediate weft wires may be provided in the region of alternation of the patterns, and a disruption of the twill line course would lie between said intermediate weft wires.

Each of said intermediate weft wires may form a tip in a twill weave.

The wire cloth may include at least one specific intermediate weft and two accompanying wefts, said specific weft being positioned laterally of said accompanying wefts and tied opposite to both of said accompanying wefts.

The specific weft with two accompanying wefts may be inserted in the region of said disruption so that the cohesiveness of said specific weft corresponds to that of the remaining wefts and the accompanying wefts continue the formation of the twill line whereas said specific weft forms a protruding tip.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 3:
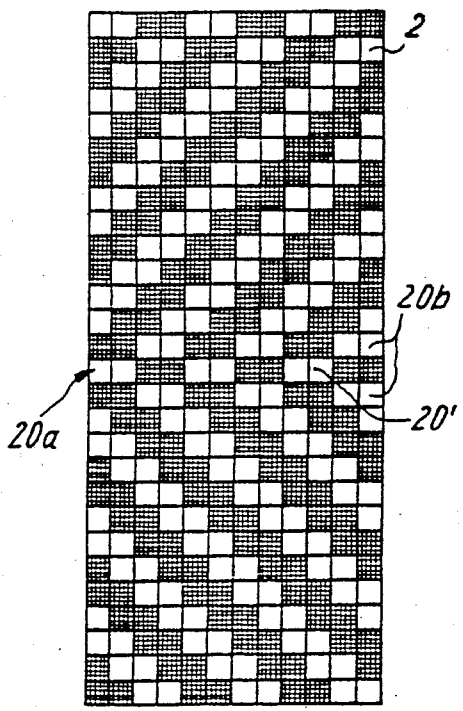
FIG. 3 illustrates the filter cloth which has in the disruption region three intermediate or alternating wefts.
Figure 2:
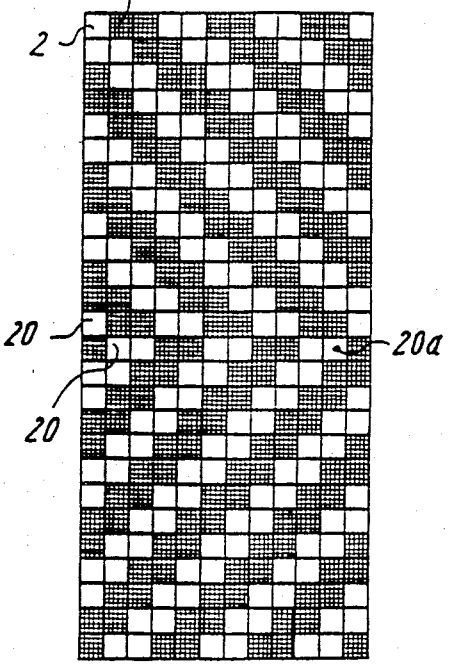
FIG. 2 shows the filter cloth with two intermediate or alternating wefts in the region of the disruption of the wale course.
Figure 1:
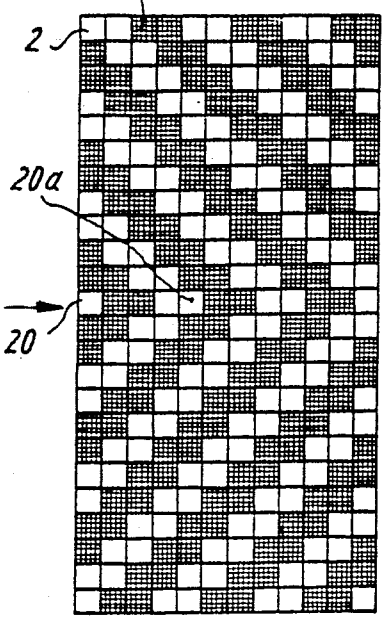
FIG. 1 illustrates a filter cloth, in which an intermediate or alternating weft is introduced in a discontinuity of a wale course.

Referring now to the drawings in detail, FIGS. 1–3 show cross-hatched fields which represent visible warps. The course of warps extends in the downward direction while the course of wefts extends from the right to the left. White fields are weft fibers shown in the front view.

As can be seen all three figures of the drawings show floating warp fibers and floating weft wires whereby the weft wire operate as 4-tie units and the warp wires are uniformly tied-up into four wire units in the region of the pattern. This is only one example of the filter cloth, and it is understandable that other ties and connections between the warps and wefts are possible.

A uniform structure of the wefts as shown in the drawings, is not, however interrupted by intermediate or alternating wefts which lie in the middle area between two patterns of each weave design. The tying of the warps is merely changed in this intermediate region.

It has been known when the same filter cloth is to be always manufactured the discontimity of the wale or seam must be positioned in the direction of warp wires.

Since, however in each case during the manufacture of the filter cloths a great variability in a mesh size is desired the discontinuity of the seam is positioned in the direction of the wefts. The warp fibers are designated in the drawings by a reference numeral 1 while the weft fibers are denoted by a reference numeral 2. Intermediate or alternating wefts are identified with reference numerals 20, 20*b*, 20′.

An alternating or intermediate weft 20 in FIG. 1 continues a wale course of the upper pattern and also of the lower pattern and forms a protruding tip or apex 20*a*.

The intermediate or alternating weft 20 closing the pattern, as shown in FIG. 2 continues the wale course whereas the second alternating or intermediate weft 20 extends exactly in the opposite direction and forms thereby a tip 20*a* and starts a new wire direction.

The advantageous structure of the filter fabric is illustrated in FIG. 3. Three alternating or intermediate wefts 20 are provided in this embodiment. Two accompanying or additional wefts 20*b* correspond to one specific intermediate weft 20′. The additional wefts 20*b* continue the wale course and remain uniform in their connection relative to the pattern weft 2. The special intermediate weft 20′ operates exactly against the tie in the pattern up to its accompanying wefts 20*b* and forms thereby a protruding tip 20*a*.

The advantage of this structure resides in that the whole specific alternating or intermediate weft is arranged so that it forms in the alternating region the tip 20*a* which prevents the formation of a hole at the tip and simultaneously closes the holes between the alternating fibers.

All three examples of the structure of the filter fabric show a variety of possibilities. Other intermediate or alternating wefts can be respectively introduced into the fabric in other types of tying.

As has been mentioned above the change in the fabric can be obtained by introducing of 8 to 20 wefts. The smaller is the distance between the alternating fibers the better is the uniformity of the filter cloth because by interchanging of the fibers and by the arrangement of the particulars intermediate wefts 20, 20*b* and 20′ the fixing of the positions of the wefts relative to the warp fibers is ensured. In all three examples the tying or weave of the wefts is not changed. The weave of the warp wires is, however changed in the region of the intermediate wefts. This region is respectively uniform in the pattern of the selected twill and extends respectively in all three examples over two fibers. In the region of intermediate wefts the warp extends occasionally only above or below the weft, and although this weft can be subjected to higher loads it never ruptures.

Further advantages of the present invention reside in that such filter fabrics provide for a uniform filtration; they bring reproducible results, they are stable, and the weft wires in the fabrics are better fixed. Thereby a uniform weft tightness in the fabric is ensured as well as an accurate mesh size.

By maintaining the twill weave of this invention, in comparison with conventional fabrics a storage effect, which the twill has as compared to linen, is fully preserved. In the filter fabric of the present invention as well as in other twill weaves, the triangular formation in the spaces between warps and wefts is eventually preserved, whereby during the filtration of, for example polymeric materials, gel is finely cut off so that the material homogeneously flows as required in the industry. The twill lace or strip has in regard to the cutting and storage capabilities substantial advantages as compared to other fabrics. Moreover, the disadvantage of known twill laces is completely eliminated in the proposed fabric by the accurate fixing of the wefts.

It will be understood that each of the elements described above, or two or more together, may also find a useful application in other types of wire filter fabrics differing from the types described above.

While the invention has been illustrated and described as embodied in a wire filter cloth, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims:

1. A wire mesh, formed as a filter mesh, of a twillplait weave, the wire mesh including individual interwoven single strand warp and weft wires being woven as a plurality of adjacent and consecutive pattern sections with each pattern section being woven as a twill pattern having diagonally running twill lines, the twill patterns in adjacent pattern sections having their twill lines running in different diagonal directions, and at least one intermediate wire woven between each pair of adjacent pattern sections so that a break region is formed between each pair of adjacent pattern sections each twill line of each pattern section of any adjacent pair of pattern sections defining included angles with their respective intermediate break region such that when said intermediate break region is considered as lying on a zero degree line the included angle defined by each twill line of one of said pair of pattern sections is an angle between zero degrees and negative ninety degrees and each twill line of the other of said pair of pattern sections is an angle between zero degrees and ninety degrees.

2. The wire mesh according to claim 1 wherein said at least one intermediate wire is a weft wire.

3. The wire mesh according to claim 1 wherein said at least one intermediate wire is a warp wire.

4. The wire mesh according to claim 1 wherein the twill lines in adjacent pattern sections intersect in said break region.

5. The wire mesh according to claim 1 including a plurality of intermediate wires forming said break region between adjacent pattern sections.

6. The wire mesh according to claim 1 wherein each said pattern section is comprised of no more than approximately twenty weft wires.

7. The wire mesh according to claim 1 wherein each said pattern section is comprised of at least eight weft wires.

8. The wire mesh according to claim 1 wherein each said pattern section is comprised of between approximately eight and twenty weft wires.

* * * * *